United States Patent [19]

Burton

[11] 4,195,762

[45] Apr. 1, 1980

[54] NAIL DISPENSING NOZZLE ASSEMBLY

[75] Inventor: Stanley J. Burton, Leigh-on-Sea, England

[73] Assignee: Fisco Products Limited, Essex, England

[21] Appl. No.: 906,948

[22] Filed: May 16, 1978

[30] Foreign Application Priority Data

May 20, 1977 [GB] United Kingdom ..... 21380/77

[51] Int. Cl.[2] ..... B25C 7/00

[52] U.S. Cl. ..... 227/156; 227/149

[58] Field of Search ..... 227/140, 149, 156; 221/310

[56] References Cited

U.S. PATENT DOCUMENTS

| | | | |
|---|---|---|---|
| 2,829,370 | 4/1958 | Humbert | 227/149 |
| 2,874,383 | 2/1959 | Wieneke | 227/149 |
| 3,816,895 | 6/1974 | Kuehn et al. | 227/149 |
| 3,854,648 | 12/1974 | Inzoli et al. | 227/149 |

FOREIGN PATENT DOCUMENTS

| | | | |
|---|---|---|---|
| 2451447 | 6/1976 | Fed. Rep. of Germany | 227/149 |

*Primary Examiner*—John McQuade

*Attorney, Agent, or Firm*—McCormick, Paulding & Huber

[57] ABSTRACT

A nozzle assembly for a nail gun includes three wing portions pivotally mounted on a nozzle holder to define a nozzle tapering towards a nozzle outlet. When the wing portions are in their inner closed position they can support an upholsterer's nail with the nail head resting on the inner walls of the nozzle, and the nail stem located in the nozzle outlet. When the nail is being driven into upholstery, the nail head forces apart the wing portions against the action of a resilient support ring. The wing portions may be surrounded by an outer casing which may be rotatable. This outer casing may have a cut-away portion or flat formed on it.

15 Claims, 7 Drawing Figures

NAIL DISPENSING NOZZLE ASSEMBLY

TECHNICAL FIELD

The present invention relates to a nozzle assembly for guiding large-headed nails. In this Specification, the expression "large-headed nails" means nails having a head which is relatively large compared to the relatively thin nail stem. One example of such a large-headed nail is an upholsterer's nail having a large nearly hemispherical head and a relatively short pointed stem.

BACKGROUND ART

A convenient method of driving upholsterer's nails into the appropriate frame or support part of upholstery is by using a nail driving device having an outlet which is held against the upholstery. In operation, the nails are driven in sequence by a driving tool from the interior of the device, through its outlet and into the upholstery. The problem arises that if a driven nail is misaligned as it leaves the device then it may not properly secure the upholstery to its respective frame or support member.

STATEMENT OF INVENTION AND ADVANTAGES

It is an aim of the invention to provide a nozzle assembly to alleviate the aforementioned problem, and accordingly there is provided a nozzle assembly for guiding large-headed nails, said nozzle assembly comprising a plurality of wing portions mounted on a nozzle holder and jointly defining a nozzle tapering towards a nozzle outlet, means retaining the wing portions in an inner closed position to support therein a nail in the aligned position with the nail head resting in the nozzle on the tapering nozzle walls and the stem located in the nozzle outlet, in which the mounted wing portions are movable outwardly with respect to each other to allow the aligned nail to pass through the outlet.

The phrase "the stem located in the nozzle outlet" is intended to include the case where the stem extends through the nozzle outlet and also where the top of the stem rests on the nozzle outlet.

The wing portions may be outwardly movable against the restraining action of a resilient retaining means. In a preferred embodiment of the invention, the wing portions are pivotally mounted on the nozzle holder against the action of a resilient retaining ring which surrounds the mounted wing portions.

The nozzle assembly may also include an outer casing mounted on the nozzle holder to surround the wing portions.

In order to drive in the nails either close to one another or close to a projecting portion of the upholstery, the problem arises that the outer casing tends to foul either an adjacent driven nail or the projecting upholstery portion. To alleviate this problem the outer casing may have a flat or a cut-away portion formed on it, and the outer casing may be rotatable with respect to the hand held position of the gun so as to present the flat or cut-away portion to an adjacent projecting upholstery portion or driven nail head.

FIGURES IN THE DRAWINGS

Embodiments of the invention will now be described by way of example with reference to the accompanying illustrative drawings in which.

DETAILED DESCRIPTION OF DRAWINGS

Figure 1:
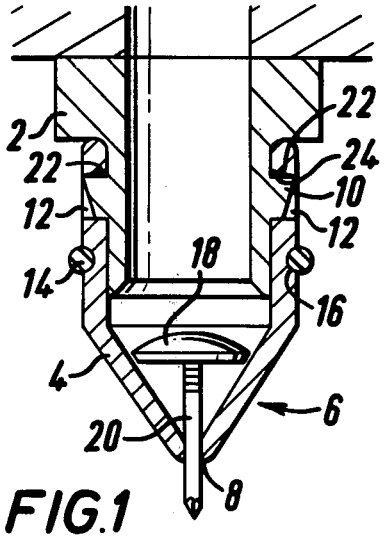
FIG. 1 is a side elevation in section of one nozzle assembly of the invention.
Figure 2:
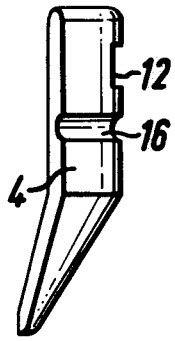
FIG. 2 is a side view of one wing portion of the assembly of FIG. 1.
Figure 3:
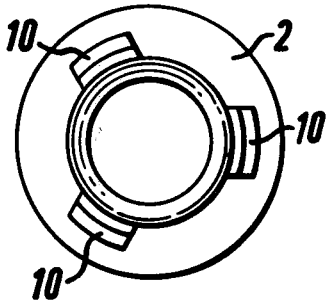
FIG. 3 is an upward view of the nozzle holder of the assembly of FIG. 1.
Figure 4:
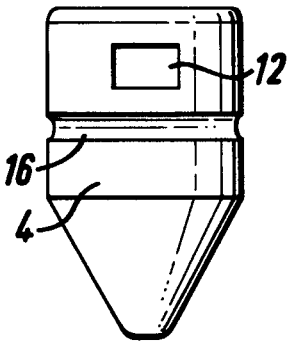
FIG. 4 is a front view of one wing portion of the assembly of FIG. 1.

Referring to FIGS. 1 to 4, one nozzle assembly of the invention includes a nozzle holder 2 secured to the magazine outlet of a nail driving device (not shown). Three wing portions 4 are mounted on the nozzle holder 2 to define a nozzle 6 which tapers towards a nozzle outlet 8.

Outwardly projecting lugs 10 located at 120° intervals on the nozzle holder 2 extend into respective locating holes 12 one on each wing portion 4. The wing portions are retained in their inner closed position illustrated in FIG. 1 by a rubber support ring 14 which is retained in a peripheral locating groove 16 in the wing portions.

The nozzle is dimensioned and arranged so that when the wing portions are in their illustrated inner closed position these portions retain an upholsterers nail in the correctly aligned position with the nail head 18 resting on the inner tapering walls of the nozzle, and the nail stem 20 extending through the nozzle outlet. The nail is retained in its correctly aligned position because the nail stem makes an easy sliding fit through the nozzle outlet, and the entire circumference of the nail head rim contacts the inner tapering walls of the nozzle.

The shape and arrangement of the lugs 10 and locating holes 12, and the resilience of the support ring 14 are such that when the nail is being driven into the upholstery by a driving tool (not shown) forming part of the nail driving device, the nail head 18 forces apart the wing portions a sufficient extent to enable the nail head 18 to pass through the now enlarged nozzle outlet. When the nail head 18 has passed through the outlet, the resilient support ring 14 returns the wing portions 4 to the illustrated closed position ready to receive the next nail to be driven. During this outward and inner movement of the wing portions 4, these wing portions pivot on the outwardly projecting lugs 10 on the nozzle holder 2. When the wing portions are in their outermost position, the upper surface 22 of each locating hole 12 lies against and parallel to the upper surface 24 of its respective lug 10.

Figure 5:
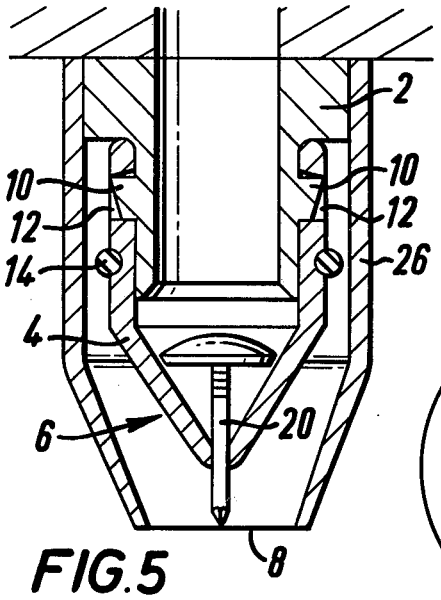
FIG. 5 is a side elevation in section of the nozzle assembly of FIG. 1 including a protective outer casing.

The nozzle assembly of FIG. 1 is a self-contained unit, but if desired an outer casing 26 may be mounted on the nozzle holder 2 as illustrated in FIG. 5. This outer casing 26 is not essential and the assembly of FIG. 1 will operate satisfactorily without the outer casing 26.

It is not essential for the nail stem 20 to extend through the nozzle outlet 8. The nozzle assembly would correctly align the nail if the tip of the nail stem merely rested on the nozzle outlet 8.

It is frequently desirable to drive in the nails so as to be either close to one another or close to a projecting portion of the upholstery. With previously proposed nail guns, the problem arises that when carrying out this "close nailing" the nozzle assembly of the gun tends to foul either an adjacent driven nail or the projecting upholstery portion. Another nozzle assembly of the invention, illustrated in FIG. 6, has been designed to alleviate this problem.

Figure 6:
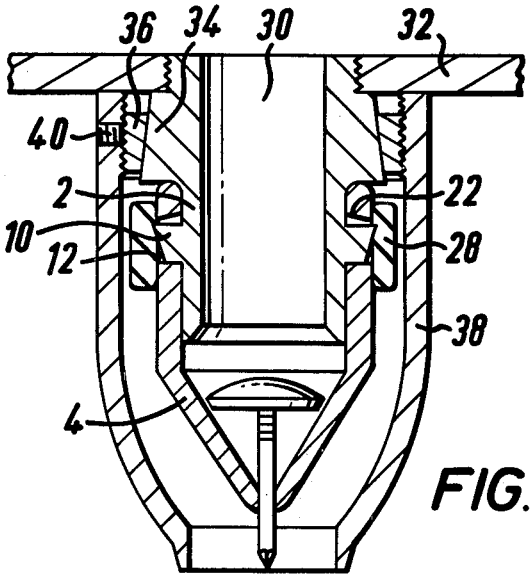
FIG. 6 is a side elevation in section of another nozzle assembly of the invention.

Referring particularly to FIG. 6, this modified nozzle assembly is generally similar to the nozzle assembly of FIGS. 1 to 5, and for clarity corresponding components have been given the same reference numerals. This nozzle assembly includes a rubber support ring 28 which is mounted on the nozzle wing portions 4 to cover the locating holes 12. This ring 28 is sufficiently wide to overlap these locating holes 12 and to bear upon the nozzle wing portions 4 to bias these wing portions towards their closed position.

The upper portion of the nozzle holder 2 is screwed into the outlet 30 of a nail driving device magazine 32. The intermediate portion 34 of the nozzle holder 2 is externally tapered towards the magazine outlet 30, and is in sliding engagement with a matching inner surface of a locating sleeve 36 which is mounted on the said intermediate portion 34. The nozzle assembly includes an outer casing 38 which is screwed onto the outer surface of the locating sleeve 36. The outer casing 38 may be secured against the rotation with respect to the sleeve 36 by suitably tightening a grub screw 40 in the casing 38 to bear upon the sleeve 36.

Figure 7:
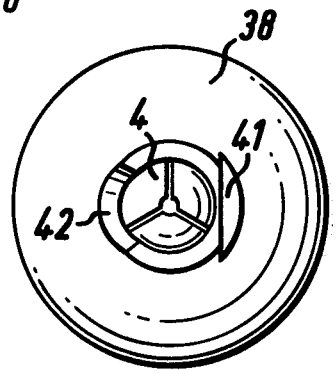
FIG. 7 is a plan view from below of the nozzle assembly of FIG. 6 showing a cut-away part and a flat.

Referring to FIG. 7, a part 42 is cut-away from the outer casing 38 near to its forward face. This cut-away part 42 is complementary to a rim portion of a nail head (not shown) where its domed surface meets its flat surface. In addition, a flat 41 is cut into the outer casing 38 diametrically opposite to the cut-away part.

When mounting the outer casing 38 on the remainder of the nozzle assembly, in order to stop the sleeve 36 from rotating, this sleeve 36 is pulled away from the magazine 32 so that the sleeve 36 locks on the intermediate portion 34 of the nozzle holder 2. The outer casing 38 is then screwed onto the sleeve 36, and when the outer casing 38 has engaged the first two or three threads on the sleeve 36 the remainder of the screwing action exerts a slide pulling force on the sleeve 36 to hold locked the sleeve 36 on the intermediate portion 34. When the outer casing 38 is fully tightened on the sleeve 36 to abut the magazine 32, the sleeve 36 is held locked onto the intermediate portion 34. The grub screw 40 is then tightened to prevent the outer casing 38 from being rotated relative to the sleeve 36.

In order to rotate the outer casing 38 with respect to the remainder of the nozzle assembly, the grub screw 40 is loosened and the outer casing 38 is unscrewed half a turn and then pushed towards the magazine 32 so as to release the sleeve 36 from the intermediate portion 34. The outer casing 38 is then rotated to a desired position, the sleeve 36 is then re-locked on the intermediate portion 34 by pulling the outer casing 38 away from the magazine 32, and the grub screw 40 is then re-tightened to secure the outer casing 38 on the sleeve 36.

If desired, the aforementioned nozzle assembly may be modified so that the outer casing 38 is frictionally and rotationally mounted on the sleeve 36. In this modification the sleeve 36 is locked on the intermediate portion 34 as previously described. The outer casing is screwed on to the sleeve 36 but it is not fully tightened. Then the grub screw 40 is tightened to lock the casing 38 on the sleeve 36. The outer casing 38 is then pushed to release the lock between the intermediate portion and the sleeve 36. The nozzle will then rotate frictionally between the faces of the portion 34 and the sleeve 36. It will be appreciated that the desired friction can be obtained by decreasing the clearance between the faces of 34 and 36 by screwing the outer casing 38 further on to sleeve 36 and then locking the grub screw 40 to the sleeve 36. A check is made for the correct frictional rotation and an adjustment is made if needed, by turning the grub screw 40. It should be noted that as wear occurs between the faces of 34 and 36 the frictional rotation can be re-adjusted as on setting by turning the grub screw 40.

The nozzle assembly of the invention is intended to be secured to the magazine outlet of a device for driving large-headed nails. The invention is not in any way restricted in its application, and two examples of the invention's application are the footwear industry and the upholstery industry.

I claim:

1. A nozzle assembly for guiding large-headed nails, said nozzle assembly comprising a nozzle holder, a plurality of wing portions mounted on the nozzle holder and jointly defining a nozzle having walls tapering towards a nozzle outlet, means retaining the wing portions in an inner closed position to support therein a nail in an aligned position relative to the nozzle outlet with the nail head resting in the nozzle on the tapering nozzle walls and the nail stem located in the nozzle outlet, in which the mounted wing portions are movable outwardly with respect to each other to allow the aligned nail to pass through the outlet, an outer casing surrounding the nozzle, locating means supporting the outer casing for rotation relative to the nozzle, and means for releasably retaining the outer casing in any selected rotational position relative to the nozzle.

2. An assembly as claimed in claim 1, in which the retaining means is resilient.

3. An assembly as claimed in claim 2, in which the wing portions are outwardly movable against the restraining action of the retaining means.

4. An assembly as claimed in claim 3, in which the retaining means is a support ring located in complementary regions of the wing portions.

5. An assembly as claimed in claim 4, in which the said complementary regions combine to form a peripheral groove around the circumference of the nozzle.

6. An assembly as claimed in claim 3, in which the wing portions are pivotally mounted on the nozzle holder.

7. An assembly as claimed in claim 6, further including outwardly projecting lugs on the nozzle holder, in which the wing portions are pivotally mounted on the said lugs which extend into respective locating holes in the wing portions.

8. An assembly as claimed in claim 7 wherein the upper surface of each locating hole lies against and parallel to the upper surface of its respective lug when the wing portions are in their outermost position.

9. An assembly as claimed in claim 1, in which the outer casing is mounted on the locating means which is mounted on the nozzle holder.

10. An assembly as claimed in claim 9, in which the outer casing can be brought into and out of fixed engagement with the nozzle holder by effecting relative longitudinal movement of the locating means and nozzle holder.

11. An assembly as claimed in claim 1, further including at least one readily identifiable feature located at a specific radial region of the outer casing.

12. An assembly as claimed in claim 11, in which the said feature is a cut-out part.

13. An assembly as claimed in claim 11, in which the said feature is a flat surface on said outer casing.

14. An assembly as claimed in claim 1 wherein the locating means comprises a locating sleeve mounted on the outer casing and surrounding a portion of the nozzle holder, the locating sleeve and the nozzle holder having coengageable surfaces, and the locating sleeve being movable relative to the nozzle holder in response to movement of the outer casing relative to the locating sleeve to vary the frictional engagement between the coengageable surfaces.

15. A nozzle assembly for guiding large-headed nails, said nozzle assembly comprising a nozzle holder, a plurality of wing portions mounted on the nozzle holder and jointly defining a nozzle having walls tapering towards a nozzle outlet, means retaining the wing portions in an inner closed position to support therein a nail in an aligned position relative to the nozzle outlet and with the nail head resting in the nozzle on the tapering nozzle walls and the nail stem located in the nozzle outlet, in which the mounted wing portions are movable outwardly with respect to each other to allow the aligned nail to pass through the outlet, an outer casing surrounding the nozzle, and a locating sleeve supporting the outer casing for rotation relative to the nozzle and having an outer surface in screw-threaded engagement with the outer casing and an inner surface tapered away from the nozzle outlet and in matching sliding engagement with a complementary surface on the nozzle holder, the outer casing being movable into and out of fixed relation with the nozzle holder by effecting relative longitudinal movement of the locating sleeve and the nozzle holder whereby the outer casing can be fixed in any selected rotational position relative to the nozzle.

* * * * *